US005947067A

United States Patent [19]

Kawaharaguchi et al.

[11] Patent Number: 5,947,067

[45] Date of Patent: Sep. 7, 1999

[54] VALVE TIMING ADJUSTMENT DEVICE

[75] Inventors: Yoshio Kawaharaguchi, Kariya; Masayasu Ushida, Okazaki; Kouji Yamada, Chiryu, all of Japan

[73] Assignee: Denso Corporation, Kariya, Japan

[21] Appl. No.: 09/139,666

[22] Filed: Aug. 25, 1998

[30] Foreign Application Priority Data

Aug. 25, 1997 [JP] Japan ..... 9-227686

[51] Int. Cl.[6] ..... F01L 1/344

[52] U.S. Cl. ..... 123/90.17; 123/90.31

[58] Field of Search ..... 123/90.15, 90.17, 123/90.31

[56] References Cited

U.S. PATENT DOCUMENTS

| | | | |
|---|---|---|---|
| 5,361,735 | 11/1994 | Butterfield et al. | 123/90.17 |
| 5,605,121 | 2/1997 | Scheidt et al. | 123/90.17 |
| 5,666,914 | 9/1997 | Ushida et al. | 123/90.17 |
| 5,738,056 | 4/1998 | Mikame et al. | 123/90.17 |
| 5,823,152 | 10/1998 | Ushida | 123/90.31 |

FOREIGN PATENT DOCUMENTS

| | | |
|---|---|---|
| 8121122 | 5/1996 | Japan . |
| 9060507 | 3/1997 | Japan . |
| 9060508 | 3/1997 | Japan . |
| 9112223 | 4/1997 | Japan . |
| 2302391 | 1/1997 | United Kingdom . |

*Primary Examiner*—Weilun Lo
*Attorney, Agent, or Firm*—Pillsbury Madison & Sutro LLP

[57] ABSTRACT

A vane type valve timing adjustment device used in an internal combustion engine, wherein a plurality of vanes are formed radially and integrally from a boss portion of a vane rotor and a stopper portion able to contact a housing side is formed at a specific vane among these. Since a large stress acts at the root portion where the specific vane connects with the boss portion, stress is prevented from concentrating at the root portion by chamfering the corner or forming a connecting part with a large radius of curvature or a non-machined surface, surface hardened surface, etc. to increase the strength.

14 Claims, 3 Drawing Sheets

VALVE TIMING ADJUSTMENT DEVICE

BACKGROUND OF THE INVENTION

1. Field of the Invention

The present invention relates to a valve timing adjustment device for changing the timing of operation of at least one of an intake valve and an exhaust valve (hereinafter the "timing of operation" referred to as a "valve timing") of an internal combustion engine (hereinafter the "internal combustion engine" referred to as an "engine").

2. Description of the Related Art

In the past, as one example of a valve timing adjustment device for adjusting the valve timing of at least one of an intake valve and an exhaust valve of an engine, it has been known to employ the vane type mechanism such as disclosed in Japanese Unexamined Patent Publication (Kokai) No. 9-112223 to the part of the drive force transmission means transmitting the drive force from a drive shaft of the engine, that is, the crankshaft, to a driven shaft, that is, the camshaft.

In this vane type valve timing adjustment device, it is necessary to provide a stopper portion to limit the amount of relative rotation of the vane rotor with respect to the housing. When providing a stopper portion at a vane, however, there is the problem that an excessive stress acts on the vane when the stopper portion is contacted. In particular, in a state where the oil pressure is lost, it is necessary to transmit the drive torque of the camshaft by just the vane, so there is a decline in reliability due to the insufficient strength of the vane. In particular, when providing a plurality of vanes, since the widths of the vanes are limited, it is difficult to give sufficient strength to the vanes.

SUMMARY OF THE INVENTION

Therefore, in view of the above problems in the related art, an object of the present invention is to provide a valve timing adjustment device having a high level of reliability for preventing damage to a vane arising from the stopper portion.

Another object of the present invention is to improve the strength at the root portion of the vane to prevent damage.

Still another object of the present invention is to ease the concentration of stress at the root portion of the vane to prevent damage.

To achieve the above object, the valve timing adjustment device of the present invention forms the corner between the outer circumference of the vane rotor and the end surface of the vane rotor to be partially recessed at the root portion of a specific vane corresponding to the stopper portion by forming a recessed portion. Therefore, stress is prevented from concentrating at the corner of the axial end of the root portion of the specific vane and according the vane is prevented from being damaged. Note that it is preferable to form the edges of the two axial ends of the specific vane to be smooth by giving them a radius of curvature r. Further, it is preferable to make the radius of curvature R of the root portion of the specific vane larger than that of other vanes.

Further, the technical means of making the root portion of the specific vane corresponding to the stopper portion a nonmachined surface may be employed together with the above configuration or alone. By this means, since the root portion of the vane is made a nonmachined surface, stress is prevented from concentrating due to tool marks oriented in the same direction.

Note that the nonmachined surface may be a surface formed by molding. For example, a die-cast surface may be used. Further, it may be a surface hardened by shot peening etc.

Further, the technical means of forming the stopper portion substantially equally in the axial direction of the vane when forming the stopper portion at the specific vane may be employed together with the above configuration or alone. By this configuration, the occurrence of stress acting to give torsion to the vane can be prevented, the concentration of stress etc. can be eased, and the durability of the vane can be improved.

Note that the stopper portion may be formed at just a specific vane of the plurality of vanes.

BRIEF DESCRIPTION OF THE DRAWINGS

These and other objects and effects of the present invention will become clear from the description of the preferred embodiments of the invention set forth below together with the accompanying drawings, in which.

DESCRIPTION OF THE PREFERRED EMBODIMENTS

Below, embodiments of the present invention will be explained with reference to the drawings.

Figure 1:
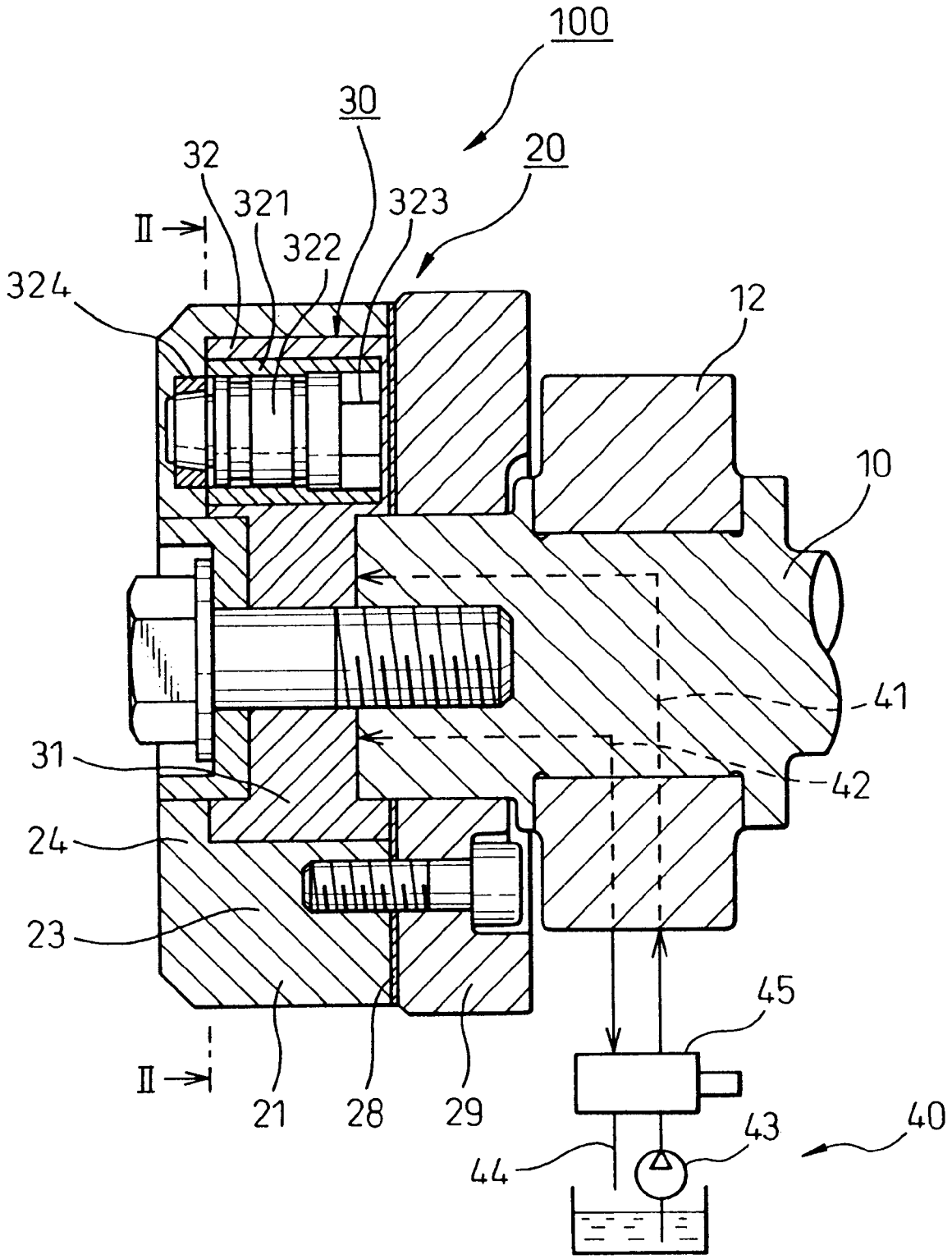
FIG. 1 is a longitudinal sectional view of a valve timing adjustment device.
Figure 2:
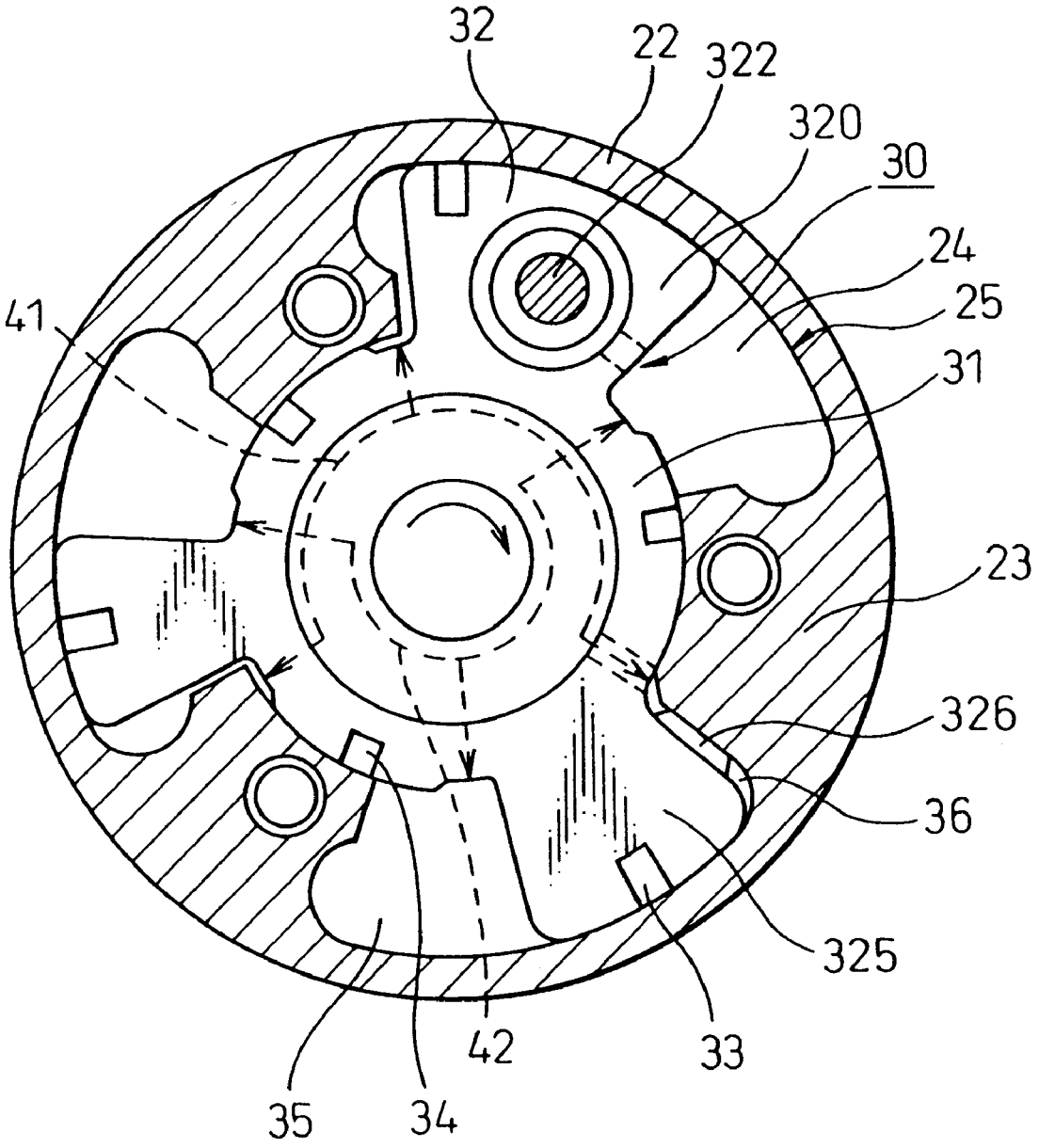
FIG. 2 is a sectional view along the line II—II of FIG. 1.
Figure 3:
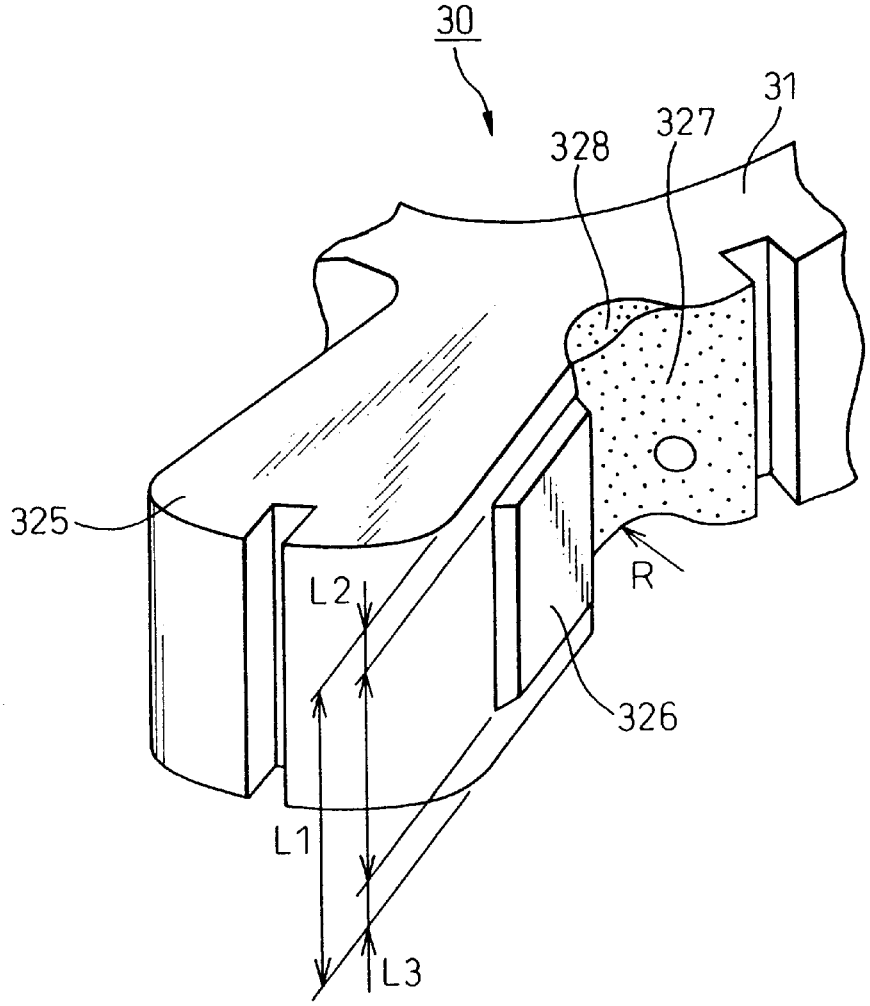
FIG. 3 is a partial perspective view of a vane rotor.
Figure 4:
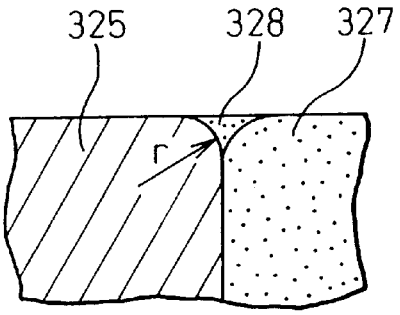
FIG. 4 is a sectional view of a root portion of a vane.

The engine valve timing adjustment device according to a first embodiment of the present invention is shown in FIG. 1, FIG. 2, FIG. 3, and FIG. 4. FIG. 1 is a longitudinal sectional view of the valve timing adjustment device. FIG. 2 is a sectional view along line II—II of FIG. 1. FIG. 3 is a partial perspective view of a vane rotor. FIG. 4 is a sectional view of the root portion of the vane.

In this embodiment, the valve timing adjustment device is used for a camshaft driving an intake valve. In FIG. 2, the illustration shows the latest angle state. The valve timing is advanced by the vane rotor turning in the clockwise direction from the illustrated state.

In FIG. 1, the camshaft 10 is supported by a camshaft bearing 12. The valve timing adjustment device 10 is provided at one end of the same. The valve timing adjustment device 100 is comprised of a housing 20 which is attached to the camshaft 10 in a manner enabling relative rotation and a vane rotor 30 fixed to the camshaft 10. The housing 20 is comprised of an aluminum case 21 and an iron gear 29.

As shown in FIG. 2, the case 21 is provided with a circumferential wall 22 and a plurality of shoe portions 23. Further, as shown in FIG. 1, it is formed integrally with a side wall 24 which closes one end of the same. Between the shoe portions 23 are formed a plurality of fan-shaped holding chambers 25. In this embodiment, three shoe portions 23 and three fan-shaped holding chambers 25 are formed. At the other side of the case 21 is attached a thin flexible metal sheet 28. Further, a gear 29 is attached and fixed by bolting. The other ends of the holding chambers 25 are closed off. The gear 29 has teeth of a gearwheel and is driven to rotate by the crankshaft through a chain, belt, or gear train.

The vane rotor 30 is provided with a boss portion 31 attached to an end of the camshaft 10 and a plurality of fan-shaped vanes 32 extending from the boss portion 31 outward in the radial direction. In this embodiment, three vanes 32 are provided corresponding to the holding chambers of the housing 20. The vanes 32 have different circumferential widths and are accommodated in the corresponding holding chambers 25.

A stopper 321 is press fit to the widest vane 320 among these vanes 32. A stopper pin 322 is accommodated in it in a state receiving a biasing force from a spring 323 to be movable in the axial direction. On the other hand, a seat ring 324 providing an engagement hole is press fit to the case 21. At the latest angle position shown in FIG. 1 and FIG. 2, as shown in FIG. 1, the stopper pin 322 projects out from the end of the vane 320 and engages with the seat ring 324 to affix the housing 20 and the vane rotor 30. Further, the stopper pin 322 receives the later mentioned working oil pressure to retract from the state shown in FIG. 1 into the vane 320 and thereby release the housing 20 and the vane rotor 30.

Further, a stopper projection 326 is formed as a stopper portion abutting against a shoe portion 23 at a specific single vane 325. This stopper projection 326 is formed only at the latest angle end. Therefore, when the stopper projection 326 abuts against the shoe portion 23, the drive torque of the camshaft 10 transmitted from the crankshaft to the housing 20 is borne only by the vane 325.

The stopper projection 326 is arranged evenly with respect to the axial width of the vane 325. In this embodiment, a single projection is formed, as shown in FIG. 3, by providing a noncontact portion of an even width L2=L3 in the vertical direction of the axial width L1. Therefore, even if the stopper projection 326 abuts against the shoe portion 23, it is possible to prevent stress in the torsional direction from acting on the vane 325.

The vane rotor 30 is formed by die-casting an aluminum material, then machining to obtain a required shape. The root portion of the vane 325, however, is left with the die-cast surface 327 as a nonmachined surface as it is only in the range shown by the dots in FIG. 3. This die-cast surface 327 is a molded surface formed by molding when the melt of the material is solidified in the mold. It is important that it be formed at the side where the stopper projection 326 is formed. By leaving this die-cast surface at this location, since that surface is not machined, the surface hardness is relatively high, so it is possible to obtain a root portion of the vane 325 which is resistant to damage even with stress concentration. Further, only the root portion of the vane 325 at the stopper projection 326 side among the three vanes 32 is connected with the outer circumferential surface of the boss 31 by a radius of curvature R larger than that of the root portions of the other vanes 32. Due to this shape, the concentration of stress at the root portion is reduced and the strength of the vane 325 is enhanced. Note that the magnitude of the radius of curvature R of the root portion is set so that the stress occurring due to fluctuations in the maximum torque of the camshaft becomes a magnitude less than a lower limit of strength of the material of the root portion.

Further, the die-cast surface 327 is formed smoothly from the outer circumferential surface of the vane rotor 30 to its end surfaces at the two axial ends of the root portion of the vane 325. That is, the outer circumferential surface and the two end surfaces of the vane rotor 30 are formed to cross each other perpendicularly across their entireties. Only at the root portion of the vane 325 at the stopper projection 326 side is formed chamfered by the radius of curvature r as with the recessed portion 328 shown in FIG. 4 so as to give a smooth curved surface. Therefore, even if stress concentrates at the root portion of the vane 325, stress can be prevented from concentrating at the corners of the two axial ends of the root portion. Therefore, it is possible to prevent damage to the vane 325 due to stress concentration.

Due to the above configuration, the vane 32 can move in the circumferential direction in the holding chambers 25 and the vane rotors 30 are arranged to be able to rotate relative to the housing 20 only within the predetermined angular range where the vanes 32 can move.

Seal members 33 are attached to the front ends of the three vanes 32 of the vane rotor 30. In the same way, seal members 34 are attached to the three outer circumferential portions of the boss portion 31. Due to this, the gap in the radial direction between the housing 20 and the vane rotor 30 is sealed. On the other hand, the vanes 32 are formed to be slightly thinner in the axial direction than the clearance between the side wall 24 and the metal sheet 28. Therefore, one end surface of the vane 32 faces the inner surface of the side wall with a slight clearance, while the other end surface of the vane 32 faces the metal sheet 28 with a slight clearance. A high seal is secured by the metal sheet 28 molding to the end surface of the vane 32 due to its elasticity.

By adopting the above seal structure, two independent chambers are formed between the housing 20 and the vane rotor 30 corresponding to the two sides of the vanes 32. In this embodiment, the clockwise direction shown by the arrows in FIG. 2 is the direction of timing advance, while the counterclockwise direction is the direction of timing delay. If a chamber positioned at the clockwise direction of a vane 32 is called an advance side volume chamber 35 and a chamber positioned at the counterclockwise side of a vane 32 is called a delay side volume chamber 36, in this case, there are three advance side volume chambers 35 and three delay side volume chambers 36.

These advance side volume chambers 35 and delay side volume chambers 36 are, as shown in FIG. 1, supplied with a working oil from the engine lubrication oil system 40. For the supply of the working oil, two systems of oil pressure channels 41 and 42 are formed in the boss portion 31 of the vane rotor 30 and in the camshaft 10. These oil pressure channels 41 and 42 are made to selectively communicate an oil pressure pump 43 and drain 44 through an electromagnetic control valve 45 so as to control the volumes of the volume chambers 35 and 36 and adjust the position of the vane rotor 30 with respect to the housing 20.

According to the embodiment explained above, since the stopper projection 326 is arranged equally in the axial range of the vane 325, it is possible to prevent stress in the torsional direction from acting on the vane 325, enhance the durability of the vane 325 itself, and enhance reliability. In particular, when making the vane 325 integral in structure with the boss portion 31, the durability of the root portion of the vane 325 can be raised. Further, since a die-cast surface 327 is left at the root portion of the vane 325, it is possible to use the relatively high hardness die-cast surface 327 to realize a high durability resistant to cracking even when stress concentrates at the root portion of the vane 325. Further, since recessed portions 328 are provided at the two axial ends of the root portion of the vane 325, it is possible to avoid concentration of stress at the two axial ends of the root portion, to prevent damage to the vane due to the progression of cracks from the two ends, and increase the reliability. In this way, in this embodiment, it is possible to provide a highly reliable valve timing adjustment device preventing damage to the vane 325.

Note that the recessed portion 328 can be replaced by planar chamfering. Further, it is important that the die-cast surface 327 be a nonmachined surface free from oriented tool marks. For example, it may be made a surface hardened surface such as a shot peened surface. Further, it is important that the stopper projection 326 be arranged substantially evenly in the axial direction of the vane 326. In FIG. 3, it is arranged evenly split into two into an upper and lower part.

While the invention has been described by reference to specific embodiments chosen for purposes of illustration, it should be apparent that numerous modifications could be made thereto by those skilled in the art without departing from the basic concept and scope of the invention.

We claim:

1. A valve timing adjustment device provided in a drive power transmission system for transmitting drive power from a drive shaft of an internal combustion engine to a driven shaft operating at least one of an intake valve and exhaust valve of the internal combustion engine, said valve timing adjustment device being provided with:

a housing for forming a holding chamber expanding in a fan shape from a rotary shaft and a vane rotor able to turn relative to said housing and having a boss portion arranged coaxially with said rotary shaft and at least one vane formed integrally with said boss portion, extending from said boss portion toward said holding chamber, and accommodated in said holding chamber;

a stopper portion able to contact one side wall of said holding chamber facing the same being formed at one side surface of a specific vane among the at least one vane in a circumferential direction of the same, and a corner between the outer circumferential surface of the vane rotor and the axial end surface of the vane rotor being formed partially smoothly at the root portion where the specific vane corresponding to the stopper portion connects with the boss portion.

2. A valve timing adjustment device as set forth in claim 1, wherein said root portion of said specific vane is a nonmachined surface.

3. A valve timing adjustment device as set forth in claim 2, wherein said nonmachined surface is a molded surface obtained by the process of molding said vane rotor.

4. A valve timing adjustment device as set forth in claim 2, wherein said nonmachined surface is a surface hardened surface.

5. A valve timing adjustment device as set forth in claim 1, wherein the root portion of said specific vane connects with the outer circumferential surface of the boss portion by a radius of curvature larger than the root portions of the other vanes.

6. A valve timing adjustment device as set forth in claim 2, wherein the root portion of said specific vane connects with the outer circumferential surface of the boss portion by a radius of curvature larger than the root portions of the other vanes.

7. A valve timing adjustment device as set forth in claim 6, wherein said nonmachined surface is a molded surface obtained by the process of molding said vane rotor.

8. A valve timing adjustment device as set forth in claim 6, wherein said nonmachined surface is a surface hardened surface.

9. A valve timing adjustment device provided in a drive power transmission system for transmitting drive power from a drive shaft of an internal combustion engine to a driven shaft operating at least one of an intake valve and exhaust valve of the internal combustion engine, said valve timing adjustment device being provided with:

a housing for forming a holding chamber expanding in a fan shape from a rotary shaft and a vane rotor able to turn relative to said housing and having a boss portion arranged coaxially with said rotary shaft and at least one vane formed integrally with said boss portion, extending from said boss portion toward said holding chamber, and accommodated in said holding chamber;

a stopper portion able to contact one side wall of said holding chamber facing the same being formed at one side surface of a specific vane among the at least one vane in a circumferential direction of the same, and a nonmachined surface being formed at the root portion where the specific vane connects with the boss portion.

10. A valve timing adjustment device as set forth in claim 9, wherein said nonmachined surface is a molded surface obtained by the process of molding said vane rotor.

11. A valve timing adjustment device as set forth in claim 9, wherein said nonmachined surface is a surface hardened surface.

12. A valve timing adjustment device as set forth in claim 9, wherein the root portion of said specific vane connects with the outer circumferential surface of the boss portion by a radius of curvature larger than the root portions of the other vanes.

13. A valve timing adjustment device as set forth in claim 12, wherein said nonmachined surface is a molded surface obtained by the process of molding said vane rotor.

14. A valve timing adjustment device as set forth in claim 12, wherein said nonmachined surface is a surface hardened surface.

* * * * *